US007258255B2

(12) United States Patent
Vogel et al.

(10) Patent No.: US 7,258,255 B2
(45) **Date of Patent: *Aug. 21, 2007**

(54) CLOSURE FOR A CONTAINER

(75) Inventors: William C. Vogel, Milwaukee, WI (US); Terrence M. Parve, Menomonee Falls, WI (US)

(73) Assignee: Gateway Plastics, Inc., Mequon, WI (US)

( * ) Notice: Subject to any disclaimer, the term of this patent is extended or adjusted under 35 U.S.C. 154(b) by 421 days.

This patent is subject to a terminal disclaimer.

(21) Appl. No.: 10/764,819

(22) Filed: Jan. 26, 2004

(65) Prior Publication Data

US 2005/0023304 A1 Feb. 3, 2005

Related U.S. Application Data

(63) Continuation-in-part of application No. 10/020,581, filed on Dec. 14, 2001, now Pat. No. 6,691,901.

(60) Provisional application No. 60/442,786, filed on Jan. 27, 2003.

(51) Int. Cl.
*B65D 47/00* (2006.01)

(52) U.S. Cl. ..... 222/556; 222/153.01; 222/480; 222/565; 220/254.2; 220/254.3; 215/237; 215/245

(58) Field of Classification Search ..... 222/556, 222/565, 536, 530, 498, 480, 153.01; 215/235, 215/237, 245; 220/833–835, 254.2, 254.3, 220/254.5

See application file for complete search history.

(56) References Cited

U.S. PATENT DOCUMENTS 3,255,928 A * 6/1966 Foster ..... 222/153.07
3,262,606 A * 7/1966 Waterman ..... 222/480
3,469,732 A * 9/1969 Foster ..... 220/835
3,542,235 A * 11/1970 Hidding ..... 220/254.2
3,604,805 A * 9/1971 Scott ..... 356/28
3,872,996 A * 3/1975 Dogliotti ..... 220/254.7
4,779,756 A 10/1988 Buelens et al.
5,579,957 A 12/1996 Gentile et al.
5,836,467 A 11/1998 Montgomery
6,660,349 B1 12/2003 Bourgeois
6,691,901 B2 * 2/2004 Parve et al. ..... 222/556
6,692,685 B1 2/2004 Willingham

OTHER PUBLICATIONS

Graphic Images: Closure # 14, document No. 001.1597652 (date unknown and presumed by the Applicant to be prior art; the Applicant reserves the right to establish a date at a future time).

* cited by examiner

*Primary Examiner*—Frederick C. Nicolas
(74) *Attorney, Agent, or Firm*—Foley & Lardner LLP

(57) ABSTRACT

A closure for a container includes a base having a first end configured for mounting on a container and a second end enclosed by a top portion. The container includes a first projection extending from an outside wall. The top portion includes a platform having at least one opening for dispensing material from the container. At least one flap is coupled to the top portion and movable between an open position for dispensing the material and a closed position for covering the opening. A second projection extends from an inside wall of the base toward the top portion and is configured to coact with the first projection on the outside of the container, so that the closure is configured to resist separation from the container once the closure has been attached to the container.

21 Claims, 15 Drawing Sheets

FIGURE 2A
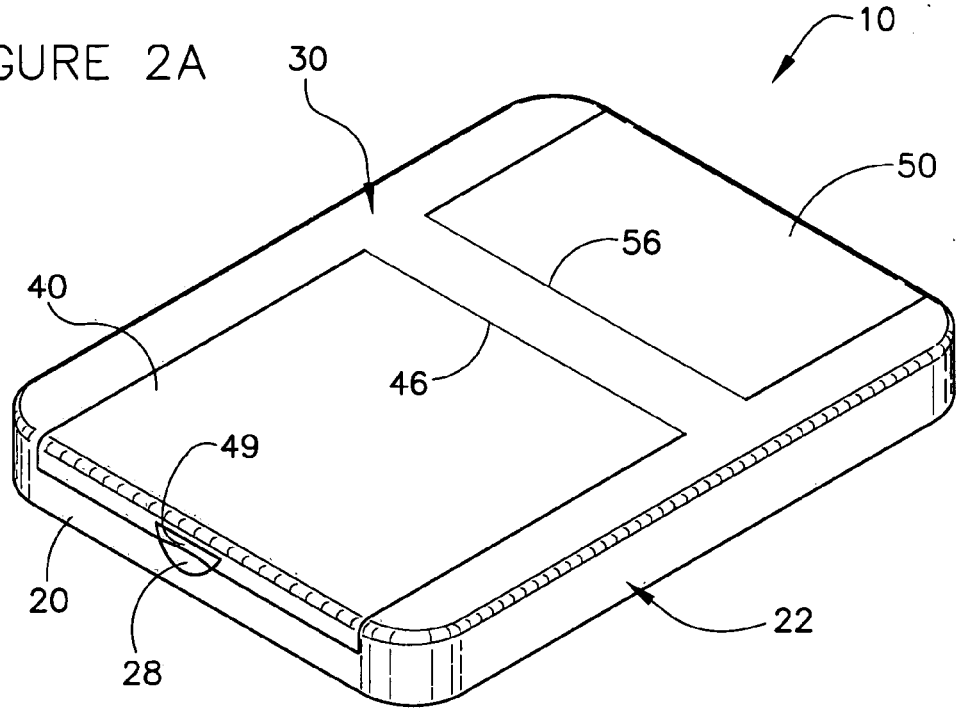
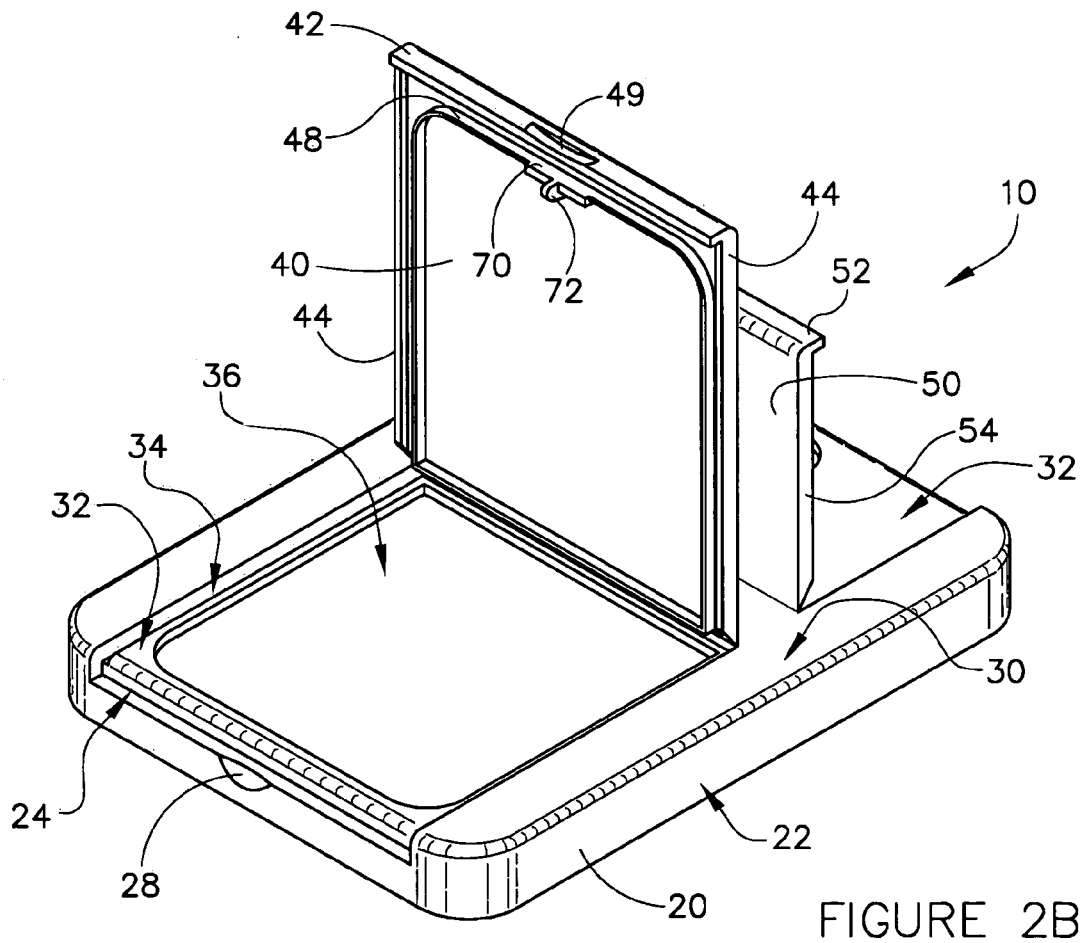
FIGURE 2B

CLOSURE FOR A CONTAINER

CROSS-REFERENCE TO RELATED PATENT APPLICATIONS

The present Application is a continuation in part of, and claims the benefit of priority as available under 35 U.S.C. §§ 120 and 121 to, U.S. patent application Ser. No. 10/020,581 titled "Closure for a Container" filed on Dec. 14, 2001 now U.S. Pat. No. 6,691,901 (which is incorporated by reference in its entirety).

The present Application also claims the benefit of priority, as available under 35 U.S.C. § 119(e)(1), to U.S. Provisional Patent Application No. 60/442,786 titled "Closure for a Container" filed on Jan. 27, 2003 (which is incorporated by reference in its entirety).

FIELD

The present invention relates to a closure for a container. The present invention more specifically relates to a non-circular closure for a container for dispensing matter from a container.

BACKGROUND

It is well known to provide a circular closure having one or more apertures for dispensing matter (e.g. particulate food stuffs or the like, such as cheese, spices, etc.) that is provided within a container. Such known closures typically have a base coupled to an opening on the container and a top having one or more dispensing apertures for dispensing the matter. Such known closures may have a removable cover or elements such as flaps that are movable between an open position in which the matter may readily be dispensed from the container (through dispensing apertures) and a closed position where the dispensing apertures are covered (so that the matter cannot readily be dispensed).

Such known circular closures may be of a type having a top with "doors" or "flaps," each covering a corresponding portion of the closure, for example, one portion having a single opening for "spooning" matter from the container and one portion having a series of smaller dispensing apertures for "shaking" matter from the container. It is known to form such closures in either of two different configurations: either as two separately formed pieces (e.g. a base with a separate top that can be assembled together) (see, e.g. U.S. Pat. No. 5,219,100 titled "Flap Closure Lockable in an Open Position" issued on Jun. 15, 1993) or as an integrally formed (single) piece (see, e.g. U.S. Pat. No. 6,250,517 titled "Integrally-Formed Container" issued on Jun. 26, 2001), from a moldable material such as plastic (e.g. in an injection molding operation).

As shown by way of example in FIGS. 1A and 1B, it is also known to provide a rectangular closure to cover a container having a rectangular shaped opening. One example of such a known closure has a rectangular base that is configured to couple to a portion of the opening of a container. The base covers a portion of the opening in the container, while a pivotal cover or element such as a flap that extends from the base covers the remaining portion of the opening. The cover includes a channel around its outer edge that is configured to receive the sides of the container that define the container opening. To dispense the contents of the container, a moveable section of the cover is pivoted upwardly to partially expose the opening of the container.

It is generally known that the formation of an injection-molded, two-piece cap or closure will allow for a die or mold that is easier to build, use and maintain, and that can be operated at a higher production rate (or throughput), in comparison with an integrally formed (one-piece) cap. Moreover, it is also generally known to be much easier to provide certain "molded-in" features in a two-piece cap, because there is less potential that such features will cause "interference" (e.g. undercuts, etc.) in separation of the mold, or other problems such as seams, differential cooling rates, warping, distortion, etc. due to the location of material injection, during the design of the mold or in the molding operation. In the separately formed pieces of a two-piece cap, features formed on one piece of the cap are generally independent of features formed on the other piece and tend to result in molds or dies that are less complex and less expensive than molds and dies for a one-piece cap. (Each piece can be formed in a separate mold, and designed independently of the other mold.)

Such two-piece closures typically have a separate top that is attached to a base to form the closure for the container. A disadvantage of such known two-piece closures is that one or more additional assembly and/or mating and alignment steps may be required to complete manufacture. Another disadvantage is that the separate pieces may become separated accidentally or inadvertently, during assembly, shipping, merchandising, storage, use or other activity which can cause damage and/or inconvenience to end users.

It would be desirable to provide a non-circular closure for a container or the like of a type disclosed in the present application that includes any one or more of these or other advantageous features:

1. A closure for a container that is integrally formed (and yet provides the desired "molded-in" features).
2. A closure for a container that is constructed of two separate pieces that may be coupled together for use as a closure for a container.
3. A closure for a container intended to retain matter within the container in the event the container is placed or falls to the side (or on its top).
4. A closure for a container having at least one cover capable of coupling to the top portion of the closure.
5. A closure for a container having two covers capable of coupling to the top portion of the closure.
6. A closure for a container having a single cover that is attached to the top portion of the closure and that is movable between the open position and the closed position.
7. A closure for a container having two covers that are attached to the top portion of the closure and that are movable between the open position and the closed position.
8. A closure for a container having a single pivotal cover that may be secured to the top by a pivot device (such as a hinge).
9. A closure for a container having two pivotal covers that may be secured to the top by pivot devices (such as hinges).
10. A closure for a container that is integrally formed yet configured so that molding "interferences" such as "drafts" and "undercuts" are not present.
11. A closure for a container providing a choice of two dispensing openings.
12. A closure for a container having a single cover configured for pivotal movement about the top to selectively open and close a pattern of dispensing openings.
13. A closure for a container having two covers configured for pivotal movement about the top to selectively open and close two patterns of dispensing openings.

14. A closure for a container having a substantially planar top surface and a lip around the outer edge of the top surface to facilitate the stacking of like containers on top of one another.

15. A rectangular closure for a container having a coupling member for coupling the closure to the container in such a way as to make removal of the closure from the container during shipping, handling, etc. difficult.

16. A closure for a container having indentations within the covers to facilitate the opening of the covers.

SUMMARY

The present invention relates to closure for a container having a base with a first end configured for mounting on a container and a second end enclosed by a top portion. The closure includes a first projection extending from an outside surface of the container. The top portion includes a platform with at least one opening for dispensing material from the container. At least one flap is coupled to the top portion and is movable between an open position for dispensing the material and a closed position for covering the opening. A second projection extends from an inside wall of the base toward the top portion and is configured to coact with the first projection on the container, so that the closure is configured to resist separation from the container once the closure has been attached to the container.

The present invention also relates to a closure for a container having a base with a first end configured for attachment to the container and a second end at least partially covered by a top portion. The top portion includes at least one opening for dispensing a material from the container and at least one flap pivotally coupled to the top portion for movement between an open position for dispensing material and a closed position to cover the opening. A tab extends from an underside of the flap. A guide is formed with the tab and has a guide surface configured to engage an edge of the opening in a wedging interaction, so that the flap is retained in the closed position by engagement between the tab and the edge of the opening.

The present invention further relates to a closure for a container having a base with a first end configured for attachment to the container and a second end coupled to a top portion. The top portion includes at least one opening for dispensing a material from the container and at least one flap pivotally coupled to the top portion by a hinge for movement between an open position for dispensing material and a closed position to cover the opening. A first channel and a second channel are formed in the top portion. A first projection extends from a first side of the flap and is configured to fit at least partially within the first channel when the flap is in the closed position. A second projection extends from a second side of the flap opposite the first side of the flap and is configured to fit at least partially within the second channel when the flap is in the closed position, so that the channels and the projections form a structure resistant to intrusion of external materials when the flap is in the closed position.

BRIEF DESCRIPTION OF THE DRAWINGS

FIG. 2A is a perspective view of a rectangular closure for a container according to a preferred embodiment illustrating the flaps in a closed position.

FIG. 2B is a perspective view of a rectangular closure for a container according to. a preferred embodiment illustrating the flaps in an open position.

DETAILED DESCRIPTION OF THE EXEMPLARY EMBODIMENTS

Figure 1A:
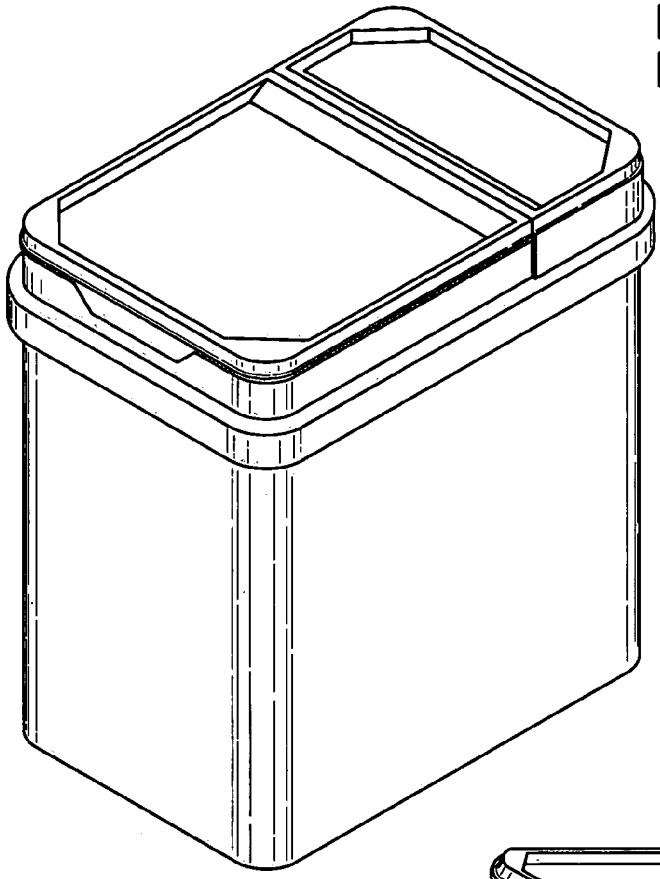
FIGURE 1A PRIOR ART
FIG. 1A is a perspective view of a prior art embodiment of a closure for a container.
Figure 1B:
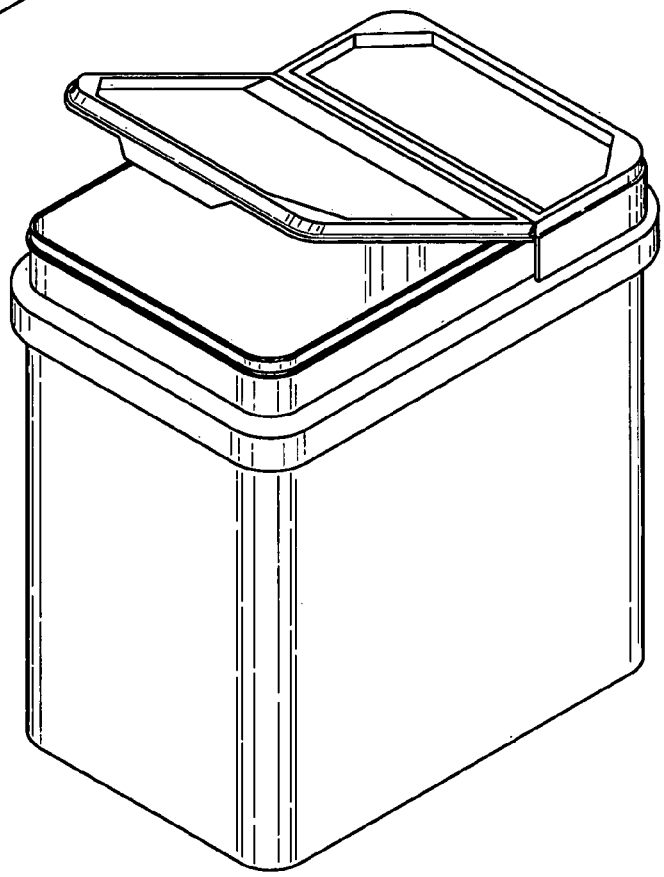
FIGURE 1B PRIOR ART
FIG. 1B is a perspective view of a prior art embodiment of a closure for a container.

Referring to FIGS. 2A through 5D, a closure 10 for a container is shown according to exemplary embodiments and may comprise a bottom portion 20, a top portion 30, a first flap 40 (e.g. spooning flap, scoop flap, etc.), and a second flap 50 (e.g. shaker flap, pour flap, etc.). The closure may be formed as a single integral unit (as shown schematically in FIGS. 2A through 2E and 3A through 5D), or as a two-piece unit (shown schematically in FIG. 2F).

According to exemplary embodiments, closure 10 for a container includes bottom portion 20 (e.g. base, bottom section, etc.). In a preferred embodiment, bottom portion 20 is shown as comprising a generally rectangular outer wall 22 (e.g. "tube," skirt, etc.) having a lower end and an upper end. However, in alternative embodiments, the bottom portion may be a "tube" having various shapes (in cross-section), such as the shape of a circle, a square, a trapezoid, a triangle, or combinations etc. The lower end of bottom portion 20 is shown as open and configured to receive and couple to an open end of a container. The upper end of bottom portion 20 is shown coupled to and enclosed by top portion 30.

According to the exemplary embodiments shown in FIGS. 2A through 5D, bottom portion 20 may be provided with a coupling member (e.g. ridge, protrusion, engagement member, flap, tab, strip, etc.) shown schematically as a projection 60. In a preferred embodiment shown schematically in FIGS. 2C and FIGS. 2G through 2I, projection 60 extends upwardly and inwardly from the inner surface of bottom portion 20 and engages with a corresponding coupling member (e.g. ridge, protrusion, engagement member, flap, tab, strip, etc.) shown schematically as projection 62 that extends outwardly and downwardly from a side wall of the container adjacent the mouth of the container. According to a preferred embodiment, the coupling members extend in a generally continuous manner around the perimeter of the closure and the container. Such a configuration is intended to allow the bottom portion to be easily coupled to the container, but makes uncoupling of the bottom portion and the container more difficult. This is intended to reduce the likelihood that the bottom portion (and hence the closure) will be uncoupled from the container during shipping or handling. As the closure is pushed onto the container, projection 60 on bottom 20 and projection 62 on the container tend to "flex" or "deform" (e.g. tend to force the projections away from one another) as they pass over each other in a sliding interaction (as shown schematically in FIG. 2H). This allows projection 60 to slide around the outside of projection 62 as the closure is pushed, completely onto the container. However, once the closure is coupled to the container, when the closure is pulled upwardly, such as in an attempt to uncouple the closure from the container, the angles of projection 60 and projection 62 will tend to force the projections toward one another, resulting in the continued engagement of projection 60 and projection 62 to retain the closure on the container. Accordingly, the removal of the closure from the container becomes relatively difficult. Additional retention structure may be provided to retain the closure on the container. For example, projections 60 and 62 may include coacting elements (e.g. hooks, barbs, fingers, etc.) and shown as barbs 64 and 66, intended to permit the closure to be installed on the container, but to provide additional structure configured to coact in a "gripping" relationship for improved retention. According to alternative embodiments, the coupling members may have any suitable shape and may be provided in a continuous or segmented pattern on the inside of the bottom portion and/or the container.

According to the exemplary embodiments shown in FIGS. 2A through 5D, bottom portion 20 may be provided with a spooning flap recess 24 (e.g. ledge, cavity, depression, indentation, socket, etc.). Spooning flap recess 24 is shown as a depression or cavity that may be provided in the outer surface of the upper end of bottom portion 20. Spooning flap recess 24 is located and configured to receive a skirt 42 that extends downwardly from the outside edge of spooning flap 40 such that skirt 42 appears to form a smooth and contiguous part of bottom portion 20 of closure 10. By providing spooning flap recess 24, skirt 42 of spooning flap 40 can be set into the outer surface of closure 10 when spooning flap 40 is closed. This is intended to reduce the risk that the skirt will be accidentally jostled and caught, the spooning flap opened, and the contents of the container spilled.

According to the exemplary embodiments shown in FIGS. 2A through 3E, bottom portion 20 may also be provided with a shaker flap recess 26 (e.g. ledge, cavity, depression, indentation, socket, etc.). Shaker flap recess 26 is similar to spooning flap recess 24, where shaker flap recess 26 is located and configured to receive a skirt 52 that extends downwardly from the outside edge of shaker flap 50.

According to the exemplary embodiments shown in FIGS. 2A through 5D, bottom portion 20 may be provided with indentations 28 (e.g. finger indentations, recesses, cavities, insets, etc.). In a preferred embodiment, an indentation 28 may be provided on the outer surface of bottom portion 20 below the central portion of each of spooning flap recess 24 and/or shaker flap recess 26. When spooning flap 40 and shaker flap 50 are in the closed position, each indentation 28 cooperates with a corresponding indentation 49, 59 that may be provided on skirts 42, 52 to effectively form a single indentation for use with each flap that is configured to receive a finger or finger nail of the user. Each of these indentations allows a user to grasp the corresponding flap and readily open it.

According to exemplary embodiments, closure 10 for a container includes top portion 30 (e.g. top section, end wall, cover, etc.). Top portion 30 covers the upper end of bottom portion 20 and provides openings through which the contents of the container may pass. According to the preferred embodiments shown in FIGS. 2A through 2E, and 3A through 5D, top portion 30 may be a generally flat member that may include one or more recessed portions or platforms 32 that are configured to receive a flap. These platforms may be different sizes depending on the size of flap that will be received within the platform. Two sides of each platform may also include recesses or channels 34 that are configured to receive skirts 44, 54 that extend from the sides of spooning flap 40 and shaker flap 50. Top portion 30 may include a spooning opening 36, a shaker opening 38, and a lip 39.

According to an exemplary embodiment shown in FIGS. 2A through 5D, top portion 30 may be provided with spooning opening 36 (e.g. first opening, aperture, hole, outlet, passage, etc.). In various exemplary embodiments, spooning opening 36 is provided within a first platform 32 of top portion 30 and may take a variety of shapes and sizes, which may vary depending of the nature of the materials that are intended to pass through spooning opening 36. Spooning opening 36 may be of such a size and shape to allow material dispensing tools or utensils, such as spoons and scoops, to pass through the opening into the container and to remove a quantity of matter from the container. In alternative embodiments, the shape of the spooning opening may be rectangular, square, triangular, circular, oval, trapezoidal, D-shaped, or a variety of other shapes and sizes.

According to an exemplary embodiment shown in FIGS. 2A through 3E, top portion 30 may be provided with one or more shaker openings 38 (e.g. second opening, aperture, hole, outlet, passage, etc.). In various exemplary embodiments, shaker opening(s) 38 is provided on a second platform 32 of top portion 30 and is generally smaller than spooning opening 36. Shaker opening(s) 38 is generally configured to permit matter to be "poured" or "shaken" from the closure and is suited for applications where it is desirable to allow less material to pass through the top portion at any one time than may pass through the spooning opening. Shaker opening(s) 38 may have a variety of shapes, sizes, and configurations, and may provide a variety of aperture patterns, all of which may vary depending of the nature of the materials that are intended to pass through the shaker opening(s). As shown schematically in FIGS. 1E and 2E, shaker opening(s) 38 may be substantially teardrop-shaped, (with the ends of the teardrop radiused and/or squared). In alternative embodiments, the shaker opening(s) may be football-shaped, circular, semicircular, oval, square, triangular, rectangular, or any combination of these or a variety of other different shapes.

According to the exemplary embodiments shown in FIGS. 3A through 3E and 5A through 5D, an upwardly projecting lip 39 (e.g. rim, upwardly protruding projection, projection, trim portion, etc.) is shown extending generally upward from top portion 30 and may be provided along all, or certain segments of, the outer periphery of the non-recessed areas of top portion 30. Lip 39 has an inner and an outer surface. The outer surface of lip 39 extends upward from the outer surface of bottom portion 20 such that the outer surface of bottom portion 20 extends beyond the top surface of top portion 30. The inner surface of lip 39 extends upward from the top surface of top portion 30 such that top portion 30 gradually transitions into the inner surface of lip 39 (i.e. with a rounded or radiused corner or contour) to provide a smooth, rounded edge. The top of lip 39 may also be rounded or radiused to provide a smooth transition from the inner surface of lip 39 to the outer surface of lip 39.

According to exemplary embodiments shown in FIGS. 2A through 5D, top portion 30 is shown to include spooning flap 40 (e.g. door, panel, lid, cover, etc.). Spooning flap 40 is coupled to top portion 30 and serves to cover and uncover spooning opening 36 when moved between a closed and open position. In the closed position, spooning flap 40 may be recessed into top portion 30 (i.e. may fit within a recessed portion of top portion 30) such that the top surface of spooning flap 40 is in substantially the same plane as the top surface of top portion 30 so as to form closure 10 for a container having a substantially flat top surface. In alternative embodiments, the flap may be different sizes and shapes. For example, in one embodiment, the spooning flap may be rectangular and occupy approximately one-third of the area of the top surface of the closure. In an alternative embodiment, the spooning flap may be square and consume approximately one-quarter of the area of the top surface of the closure.

According to a preferred embodiment, spooning flap 40 includes coacting elements, a hinge 46, a clean-out ring 48, skirts 42, 44, an indentation 49, and a lip 39.

According to the exemplary embodiments shown in FIGS. 2A through 5D, spooning flap 40 may be provided with coacting elements (e.g. retaining member, coupling member, finger, interface, lock, etc.) configured to attach spooning flap 40 to top portion 30 when the flap is in the closed position. The coacting elements include a tab 70 and/or a guide 72 configured to frictionally engage an edge of spooning opening 36 in a wedging interaction. In an alternative embodiment, the spooning flap and the top portion may include coacting elements configured to create a retention force sufficient to hold the flap in an open position when the flap is moved to the open position, so that the flap does not interfere with dispensing contents from the container. The flap may be closed by applying a force in the closing direction that is sufficient to overcome the retention force between the coacting elements.

According to the exemplary embodiments shown in FIGS. 2A through 5D, tab 70 (e.g. interface, projection, protrusion, finger, coupling, member, etc.) may be a member (e.g. panel, plate, etc.) that projects downwardly and outwardly from the underside of spooning flap 40. Tab 70 is shown angled outwardly so that an outward surface (i.e. the surface of tab 70 that is closest to the outside of closure 10) is configured to frictionally engage the inner edge of spooning opening 36 when spooning flap 40 is in the closed position. As a result, when spooning flap 40 is closed, the lower end of tab 70 frictionally engages the inner edge of spooning opening 36 to secure spooning flap 40 in the closed position by a wedging interaction. Reopening spooning flap 40 requires the application of a force sufficient to overcome the frictional interaction of tab 70 with the inner edge of spooning opening 40.

According to the exemplary embodiments shown in FIGS. 2A through 5D, the guide 72 (e.g. reinforcing member, stiffener, rigidifier, brace, rib, etc.) is a member (e.g. finger, panel, plate, etc.) shown projecting downwardly from the underside of spooning flap 40. According to one exemplary embodiment, guide 72 may be joined with and oriented substantially perpendicular to tab 70 resulting in a projection that has a substantially "T-shaped" configuration. In such a configuration, guide 70 has an outward surface (i.e. the surface nearest the outside of the closure) that is coincident to the outward surface of tab 70, with a lower end of guide 72 extending beyond the lower end of tab 70. Over the distance that guide 72 extends beyond tab 70, the outward surface of guide 72 may be curved to provide a curved guide surface (i.e. cam) that interacts with the inner edge of spooning opening 36. The curved guide surface may be defined by multiple radii to create a wedging interaction with the inner edge of spooning opening 36 as spooning flap 40 is moved into the closed position, or may alternatively be defined by a single radius. According to alternative embodiments, the guide may take a variety of orientations with respect to the tab, or the guide may be absent from the spooning flap.

According to the exemplary embodiments shown in FIGS. 2A through 5D, spooning flap 40 is coupled to top portion 30 by a hinge 46 (e.g. living hinge, integrally formed hinge, retaining element, coupling member, pivot device, etc.). In a preferred embodiment, hinge 46 is flexible and integrally formed between top portion 30 and spooning flap 40 and defined by a groove preferably extending along a straight line for substantially the entire length of spooning flap 40. According to an alternative embodiment, spooning flap 40 may be provided with lateral projections (e.g. pins, posts, prongs, axles, etc.) extending from opposites sides of the spooning flap and configured for an interference type fit (e.g. press-fit, etc.) within corresponding recesses (e.g. sockets, receptacles, etc.) provided in the top portion, so that the projections are movable within the recesses to provide a hinge for movement of the spooning flap from the open position to the closed position.

According to the exemplary embodiments shown in FIGS. 2A through 5D, a clean-out ring 48 (e.g. rim, projection, ring, lip, etc.) is shown extending from the underside of spooning flap 40 in a shape that is substantially identical to the shape of spooning opening 36. With respect to a cross-section of clean-out ring 48, the clean-out ring is shown as a downwardly extending projection that protrudes from the underside of spooning flap 40. Clean-out ring 48 extends from the bottom of spooning flap 40 for a distance that allows the lower end of the projection to extend partially into spooning opening 36 when spooning flap 40 is in the closed position, so that the distance the lower end of clean-out ring 48 extends away from the bottom of spooning opening 36 is less than the thickness of platform 32 that includes spooning opening 36. In a preferred embodiment, clean-out ring 48 is shaped to fit within spooning opening 36 such that an outer surface of clean-out ring 48 is close enough to the inner edge of spooning opening 36 to minimize the amount of matter that may escape between clean-out ring 48 and the inner edge of spooning opening 36, but does not frictionally engage the inner edge of spooning opening 36. This configuration is intended to allow spooning flap 40 to minimize the escape of any matter provided within the container without increasing the force required to open or close spooning flap 40.

According to the exemplary embodiments shown in FIGS. 2A through 5D, a downwardly extending skirt 42 (e.g. projections, sides, protrusions, edges, etc.) may be provided on the outside edge of the underside of spooning flap 40. In one preferred embodiment, skirt 42 extends from the underside of spooning flap 40 at an angle of between 9 and 25 degrees, and more preferably between an angle of 15 and 20 degrees, with respect to a plane parallel to the longitudinal axis of the container and to hinge 46. In other embodiments, skirt 42 may extend perpendicularly, or at various other angles, from the underside of spooning flap 40. The outer surface of skirt 42 may conform to the outer surface of bottom portion 20 such that when spooning flap 40 is closed, skirt 42 fits within recess 24 provided in bottom portion 20 and provides, in combination with bottom portion 20, a closure having a substantially uniform vertical surface. In alternative embodiments, the skirt may extend along the full length of the outside edge of the spooning flap, or the skirt may extend over only a portion, or portions, of the outside edge of the spooning flap.

According to a preferred embodiment, spooning flap 40 may also include skirts 44 (e.g. side skirts, walls, projections, etc.) on two opposite side edges of spooning flap 40. Skirts 44 may extend a shorter distance from spooning flap 40 than skirt 42 provided on the outside edge of spooning flap 40 and "fit" within channels 34 (e.g. recesses, troughs, gutters, etc.) provided on the sides of platform 32 in top portion 30, without frictional engagement. The interaction of side skirts 44 within channels 34 is intended to provide a structure (e.g. barrier, obstacle, etc.) configured to prevent intrusion of foreign matter or external materials (e.g. dirt, dust, moisture, rainwater, contaminants, etc.) into the container when the flaps are closed. In the event that moisture or water infiltrates beneath the flaps, the channels are configured to drain such moisture or water away from the openings to minimize intrusion to the container.

According to the exemplary embodiments shown in FIGS. 2A through 5D, an indentation 49 (finger ridge, finger indentation, recess, cavity, inset, etc.) is provided at a central outer portion of skirt 42 that is configured to receive a finger or finger nail of the user. Indentation 49 of skirt 42 on spooning flap 40 cooperates with indentation 28 provided on bottom portion 20 to allow the user to grasp spooning flap 40 and readily open it.

According to the exemplary embodiments shown in FIGS. 3A through 3E and 5A through 5D, spooning flap 40 may be provided with a lip 39 (rim, rail, brim, projection, border, etc.). Lip 39 extends upwardly from the outer edge of spooning flap 40 and cooperates with a recess or radius provided along the outer edge of the bottom of a container that is or may be stacked on top of the closure. Lip 39 serves to facilitate the stacking of like containers on top of one another by orienting the bottom of the next higher container, which keeps the bottom of the next higher container in proper alignment when stacked. Lip 39 that may be provided on spooning flap 40 is similar to, and serves the same function as, lip 39 that may be provided on top portion 30.

According to the exemplary embodiments shown in FIGS. 2A through 3E, top portion 30 is shown to include shaker flap 50 (e.g. door, panel, lid, cover, etc.). Shaker flap 50 is coupled to top portion 30 and serves to cover and uncover shaker opening(s) 38 when moved between a closed and open position. In a closed position, shaker flap 50 may be recessed into top portion 30 (i.e. may fit within recess 26 in top portion 30) such that the top surface of shaker flap 50 is in substantially the same plane as the top surface of top portion 30 so as to form a closure for a container having a substantially flat top surface. Like spooning flap 40, shaker flap 50 may have a different size and/or shape in alternative embodiments. Moreover, in various alternative embodiments, the spooning flap and shaker flap may have the same size and shape or they may have different sizes and shapes.

According to a preferred embodiment, shaker flap 50 includes coacting elements, a hinge 56, a clean-out ring(s) 58, skirts 52, 54, an indentation 59, and a lip 39.

According to the exemplary embodiments shown in FIGS. 2A through 3E, shaker flap 50 may be provided with coacting elements 70, 72 (e.g. retaining member, coupling member, finger, interface, lock, etc.) that are essentially identical to the coacting elements 70, 72 described above in relation to spooning flap 40. In a preferred embodiment, one set of coacting elements is provided to frictionally engage with an edge of at least one of shaker openings 38. However, in alternative embodiments, more than one set of coacting elements may be provided to frictionally engage with an edge of more than one of the shaker openings.

According to the exemplary embodiments shown in FIGS. 2A through 3E, shaker flap 50 is coupled to top portion 30 by a hinge 56 (e.g. living hinge, integrally formed hinge, retaining element, coupling member, pivot device, pin and socket device, etc.) that is essentially identical to hinge 46 described above in relation to spooning flap 40.

According to the exemplary embodiments shown in FIGS. 2A through 3E, shaker flap 50 include clean-out ring(s) 58 (e.g. rim, projection, ring, lip, etc.) extending from the underside of shaker flap 50 in a shape that is substantially identical to the shape of shaker opening(s) 38. Clean-out ring(s) 58 for shaker opening(s) 38 is similar to clean-out ring 48 described above in relation to spooning flap 40, except that there may be more than one clean-out ring 58 provided on the underside of shaker flap 50 depending on the number of shaker openings 38 provided.

According to the exemplary embodiments shown in FIGS. 2A through 3E, a downwardly extending skirt 52 (e.g. projections, sides, protrusions, edges, etc.) may be provided on the outside edge of the underside of shaker flap 50. Similar skirts 54 (e.g. side skirts) may also be provided on the two side edges of shaker flap 50. Skirts 54 that may extend from the shaker flap are substantially similar to skirts 44 described above in relation to spooning flap 40.

According to the exemplary embodiments shown in FIGS. 2A through 3E, an indentation 59 (e.g. finger ridge, finger indentation, recess, cavity, inset, etc.) may be provided at a central outer portion of skirt 52 and is configured to receive a finger or finger nail of the user. Indentation 59 is substantially identical to indentation 49 described above in relation to spooning flap 40.

According to the exemplary embodiments shown in FIGS. 3A through 3E, shaker flap 50 may be provided with a lip 39 (e.g. rim, rail, brim, projection, border, etc.). Lip 39 is substantially identical to lip 39 described above in relation to spooning flap 40.

According to any preferred embodiment, the closure may be made of a moldable material (e.g. plastic, etc.) in a forming process (e.g. injection molding process, etc.). The moldable material (e.g. plastic, etc.) may be provided as a generally transparent material (e.g. clear, tinted, etc.) or as a generally opaque material (e.g. non-transparent, colored, etc.). The moldable material may be other suitable moldable plastics or other suitable materials for molding a closure.

According to any preferred embodiment, the closure may be formed integrally, as a single unit, or in separate pieces that may be coupled together to form a closure (e.g. separate base and top portion configured to be coupled, removable flaps pivotally coupled by a pin-and-socket configuration, etc.). Closures that are integrally formed tend to reduce the number of manufacturing or assembly steps required and provide a more uniform appearance. Closures formed in separate pieces (e.g. two-piece, removable flaps, etc.) can generally be configured with a more complex combination of features because the use of separate molds for the pieces tends to reduce the complications resulting from the geometry of the features (such as interferences, undercuts, etc.) that may otherwise hinder the "releasability" of integrally formed closures from the mold. Closures formed in separate pieces also generally provide a more simplified flow path for the injected material which tends to reduce distortion factors (e.g. differential cooling rates, air pockets Within the mold, etc.), seams or mold lines and other complications that are associated with mold development for one-piece closures. In sum, the constraints and design considerations that must be taken into account in each method of formation differ due to various molding considerations, including the number of required pieces in the molds, the cost of the molds, cooling considerations, the angles at which the molds are released from the molded part, mold wear, etc.

The closure of a container described above may be provided in a variety of different sizes, and each size may be either integrally formed or formed from separated pieces that are coupled together to form the closure. For example, the closure may be of a relatively large size to accommodate bulk containers, or it may be of a relatively small size to accommodate small portion containers. Due to the various molding considerations discussed above (including mold cost), a preferred embodiment of a larger-sized closure may be formed from two separate pieces while a preferred embodiment of a smaller-sized closure may be integrally formed.

Figure 2C:
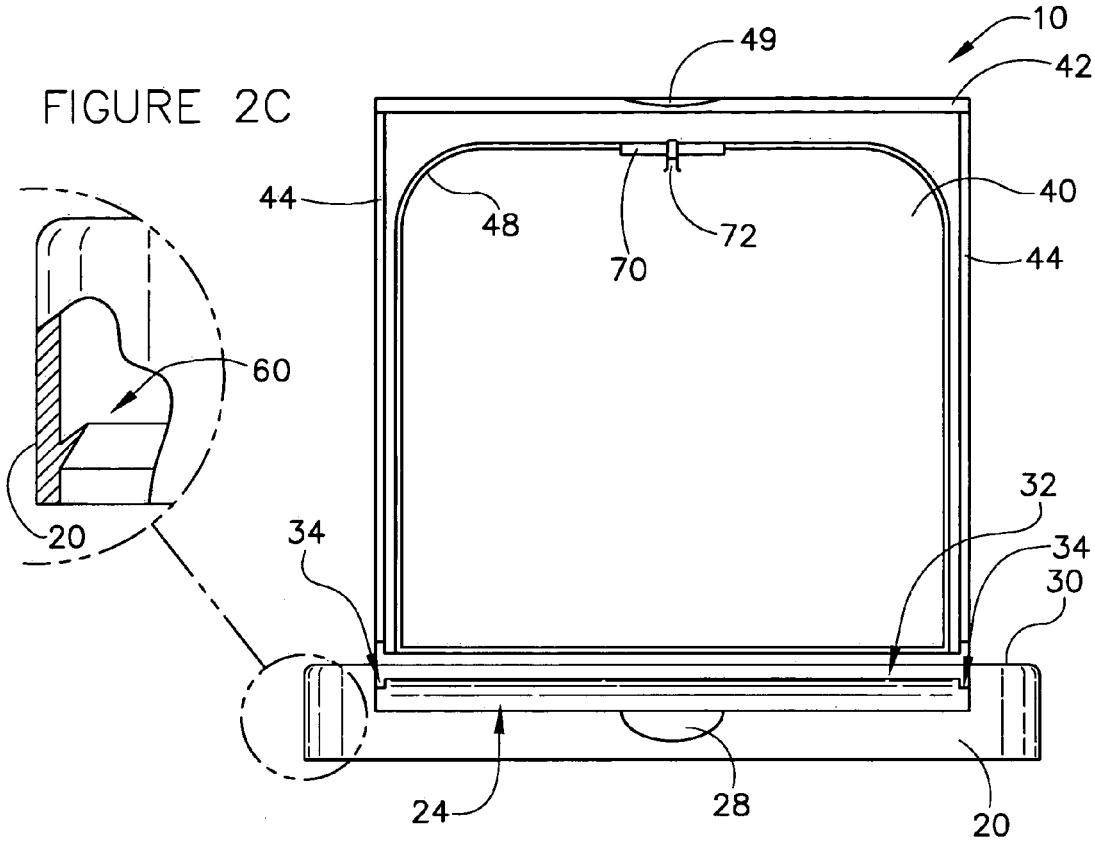
FIG. 2C is a side elevational view of a rectangular closure for a container according to a preferred embodiment illustrating the flaps in an open position and illustrating an enlarged cutaway view of the engagement member.
Figure 2D:
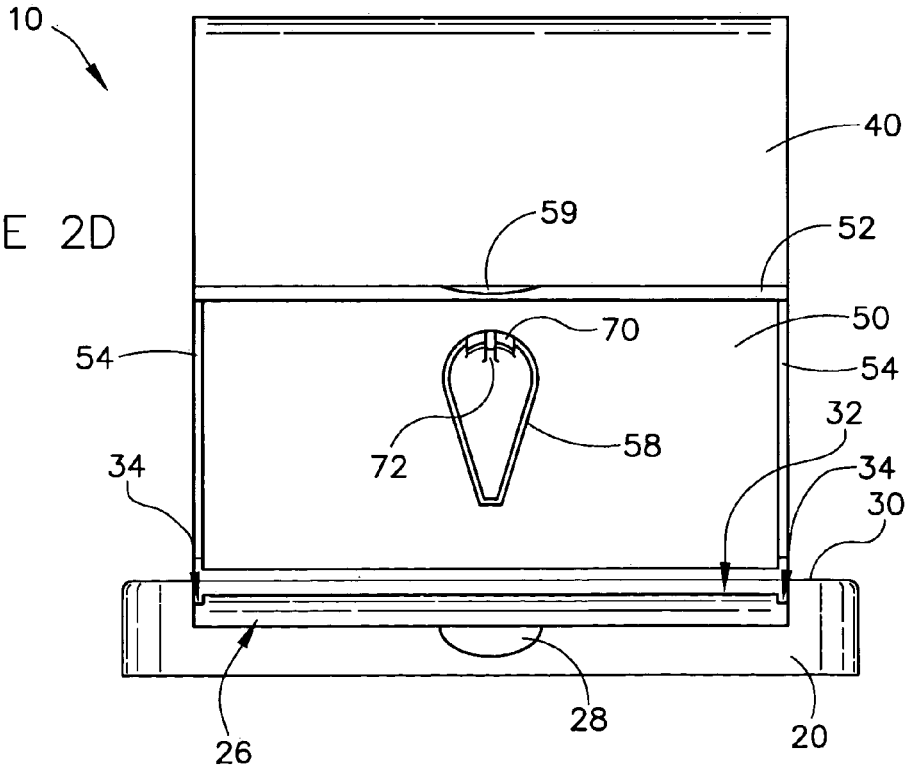
FIG. 2D is a side elevational view of a rectangular closure for a container according to a preferred embodiment illustrating the flaps in an open position.
Figure 2E:
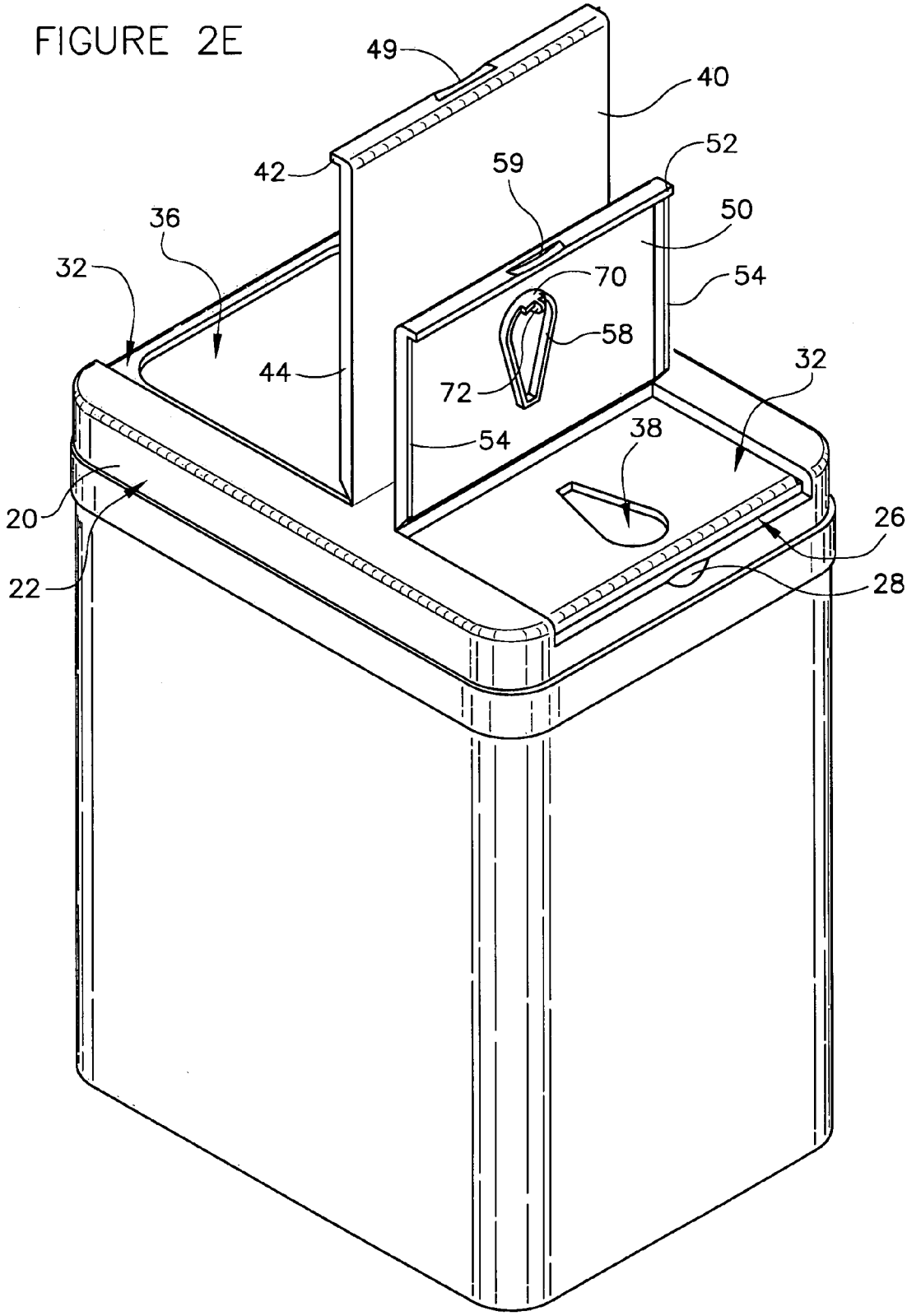
FIG. 2E is a perspective view of a rectangular closure for a container according to a preferred embodiment showing the closure coupled to a container and illustrating the flaps in an open position.
Figure 2F:
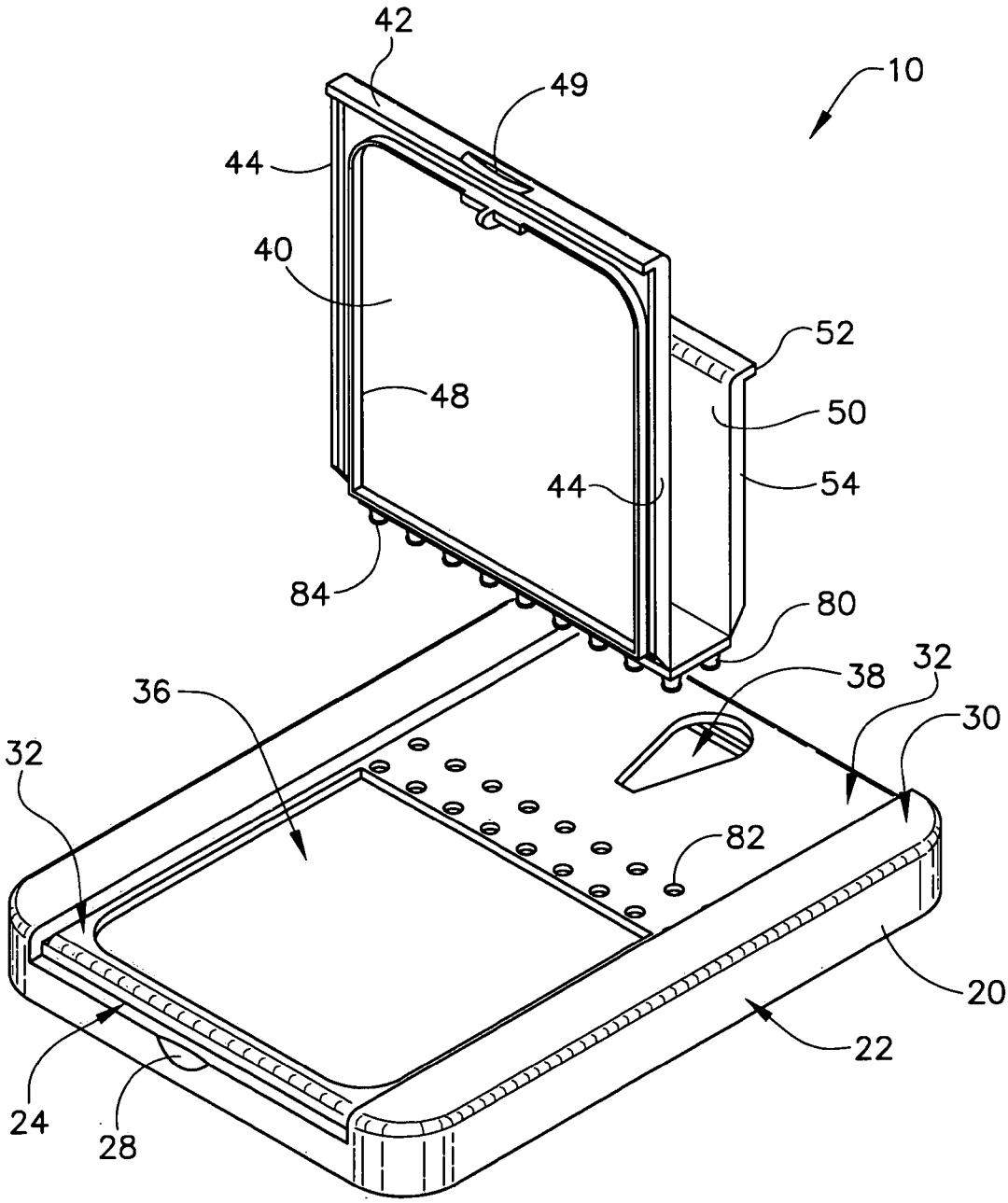
FIG. 2F is an exploded perspective view of a rectangular closure for a container according to an alternative embodiment showing a two-piece construction of the closure illustrated in FIGS. 2A through 2E.
Figure 2G:
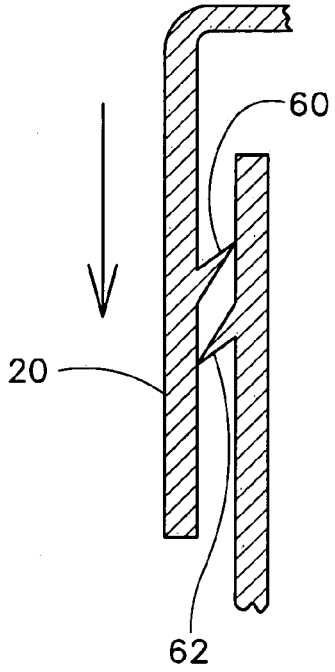
FIG. 2G is a cross-sectional view of a portion of a wall of a closure and a mouth of a container according to a preferred embodiment.
Figure 2H:
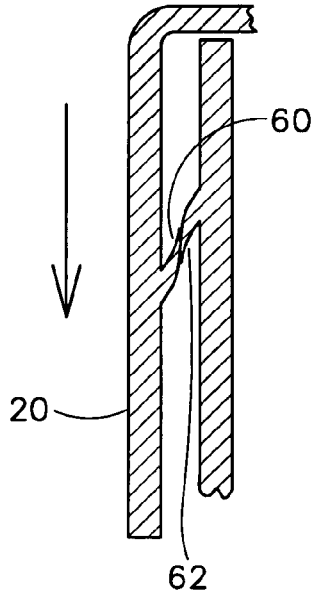
FIG. 2H is another cross-sectional view of the portion of a wall of a closure and the mouth of a container of FIG. 2G according to a preferred embodiment.
Figure 2I:
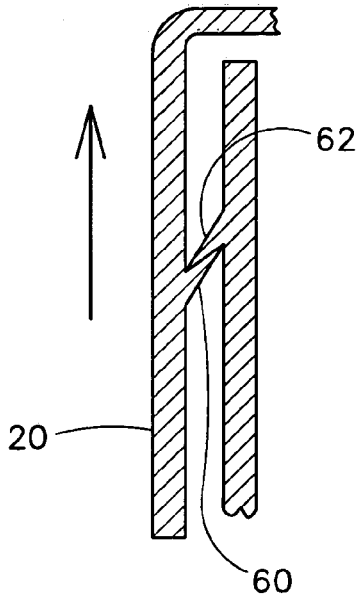
FIG. 2I is a further cross-sectional view of the portion of a wall of a closure and the mouth of a container of FIG. 2G according to a preferred embodiment.
Figure 2J:
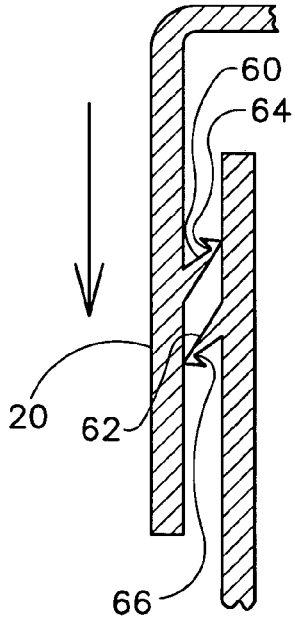
FIG. 2J is a further cross-sectional view of the portion of a wall of a closure and the mouth of a container of FIG. 2G according to a preferred embodiment.
Figure 3A:
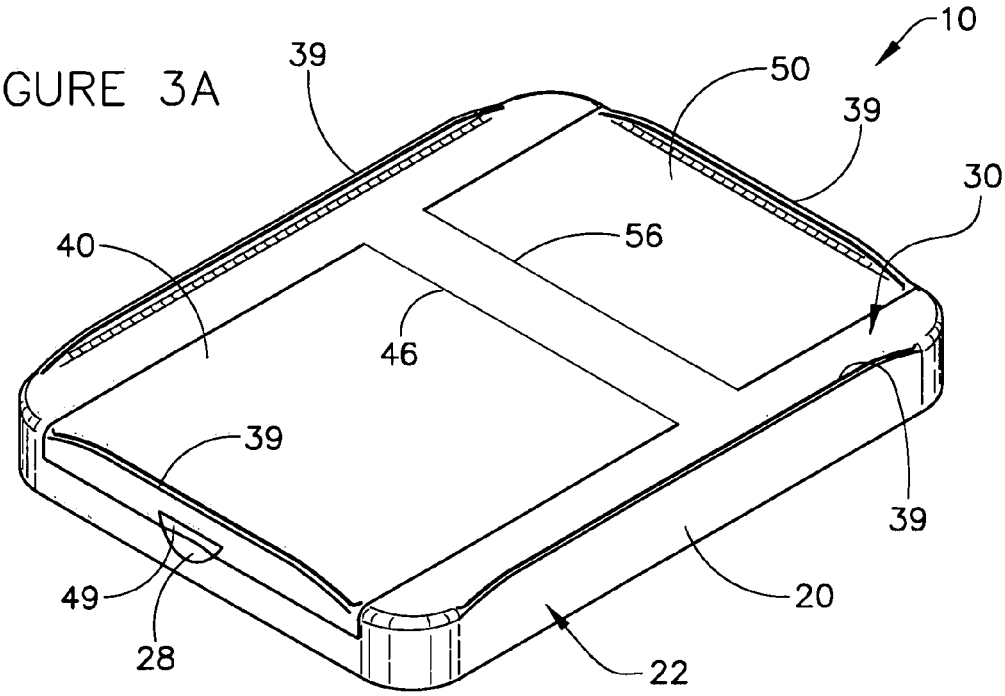
FIG. 3A is a perspective view of a rectangular closure for a container according to another preferred embodiment illustrating the flaps in a closed position.
Figure 3B:
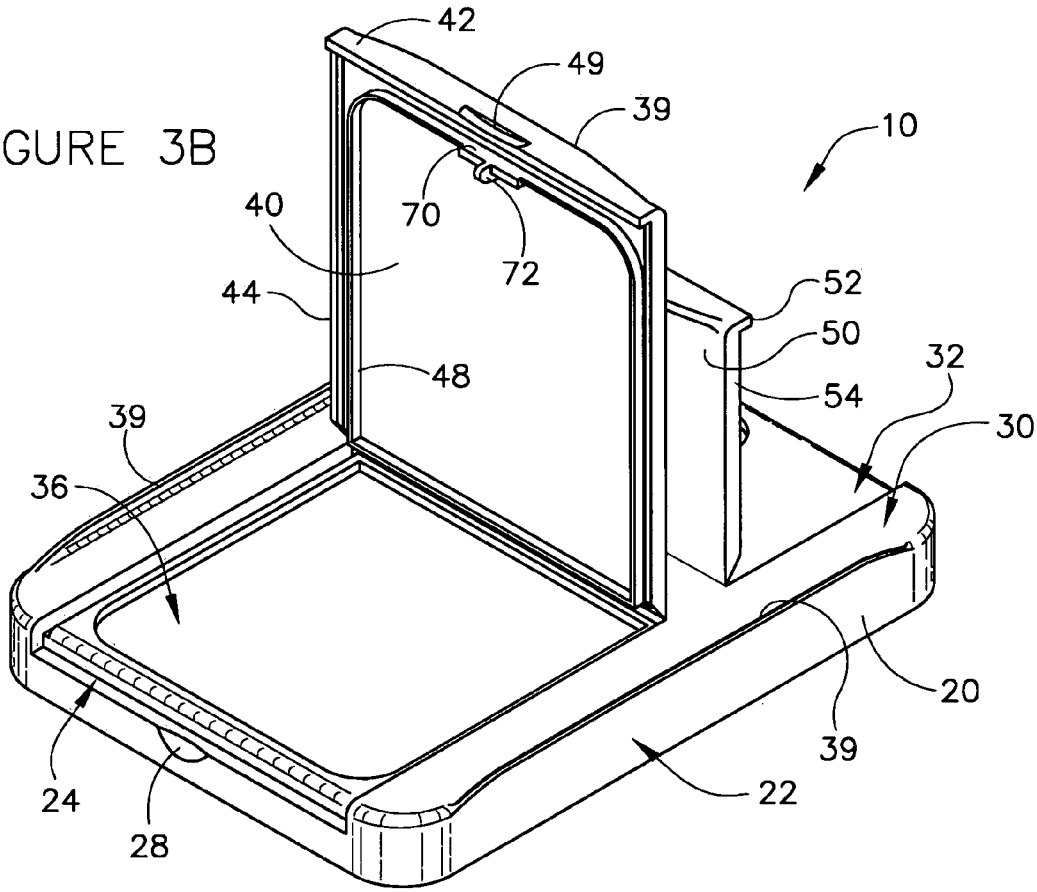
FIG. 3B is a perspective view of a rectangular closure for a container according to another preferred embodiment illustrating the flaps in an open position.
Figure 3C:
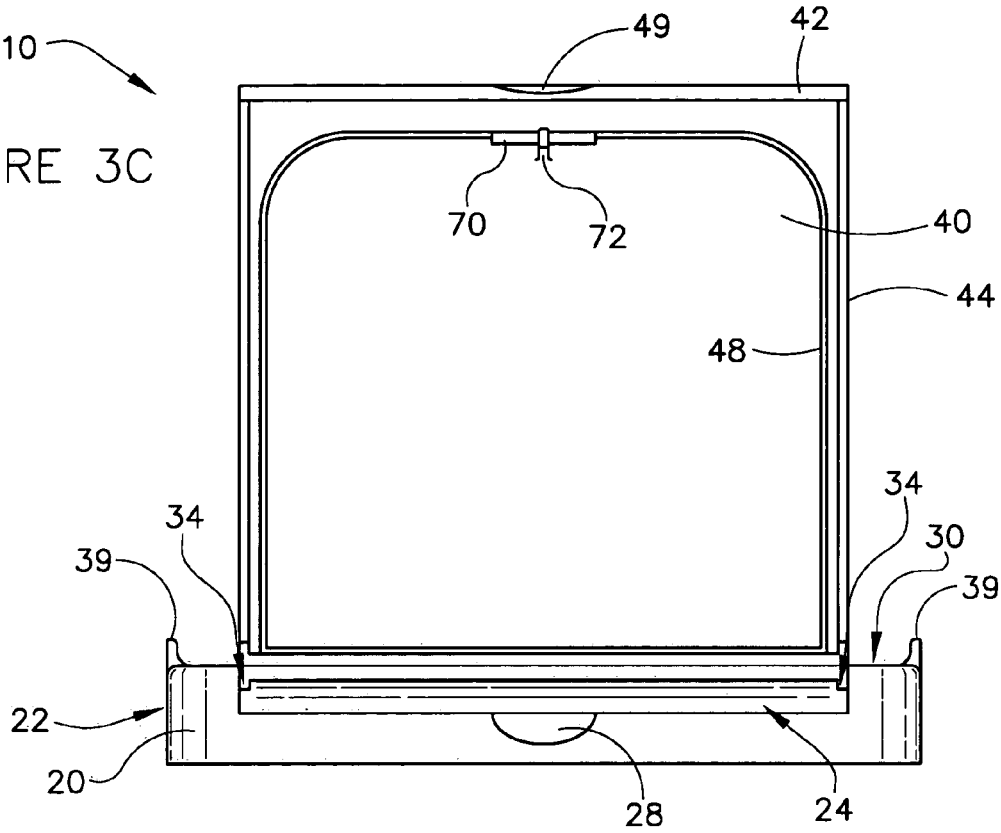
FIG. 3C is a side elevational view of a rectangular closure for a container according to another preferred embodiment illustrating the flaps in an open position.
Figure 3D:
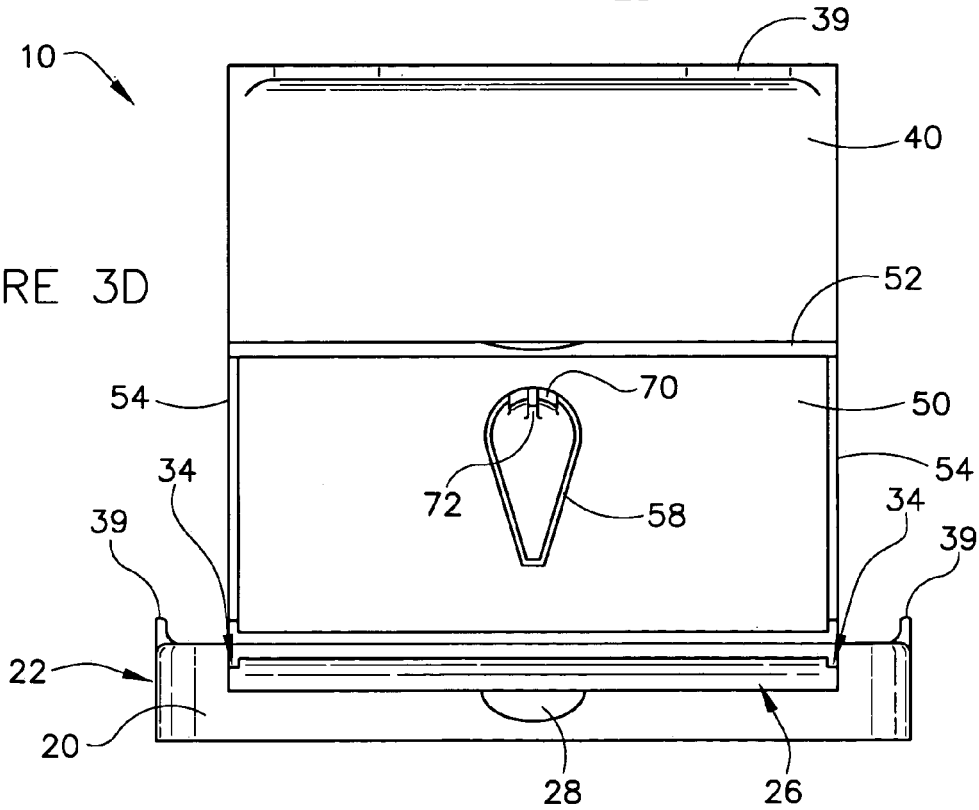
FIG. 3D is a side elevational view of a rectangular closure for a container according to another preferred embodiment illustrating the flaps in an open position.
Figure 3E:
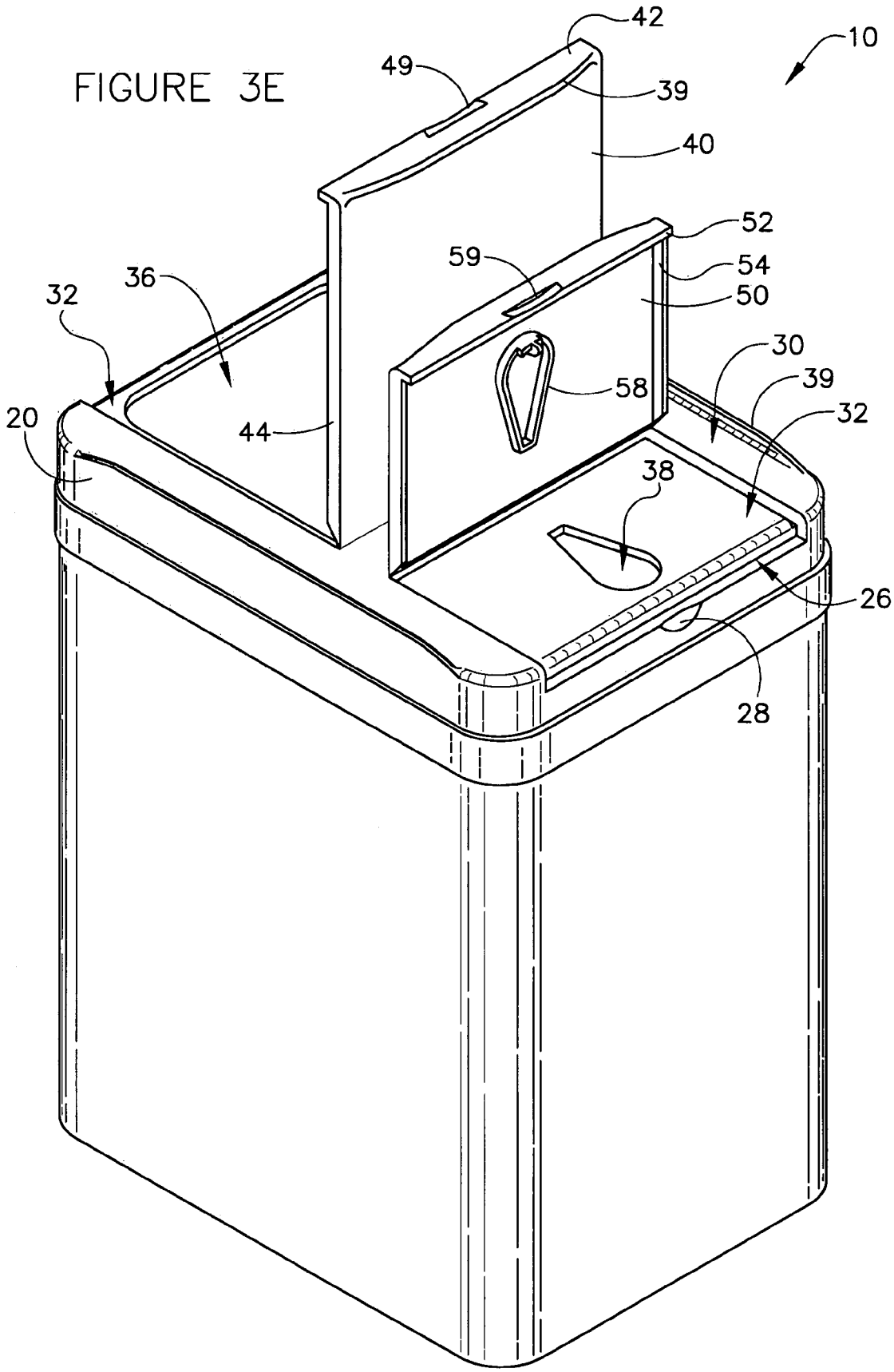
FIG. 3E is a perspective view of a rectangular closure for a container according to another preferred embodiment showing the closure coupled to a container and illustrating the flaps in an open position.
Figure 4A:
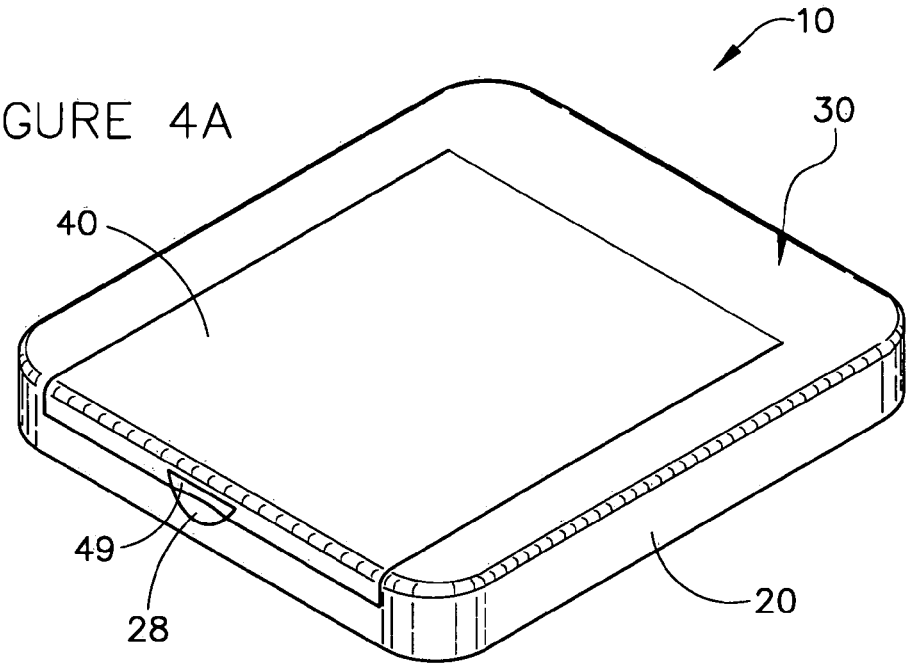
FIG. 4A is a perspective view of a rectangular closure for a container according to yet another preferred embodiment illustrating the flap in a closed position.
Figure 4B:
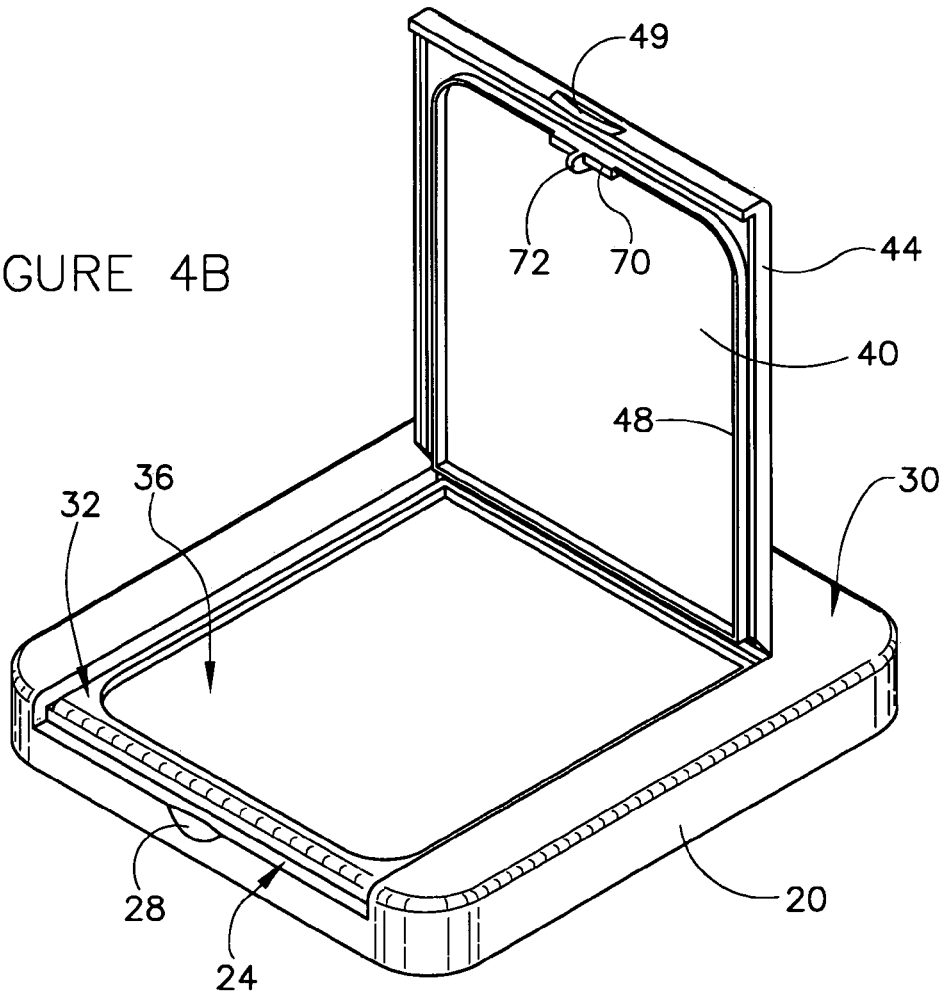
FIG. 4B is a perspective view of a rectangular closure for a container according to yet another preferred embodiment illustrating the flap in an open position.
Figure 4C:
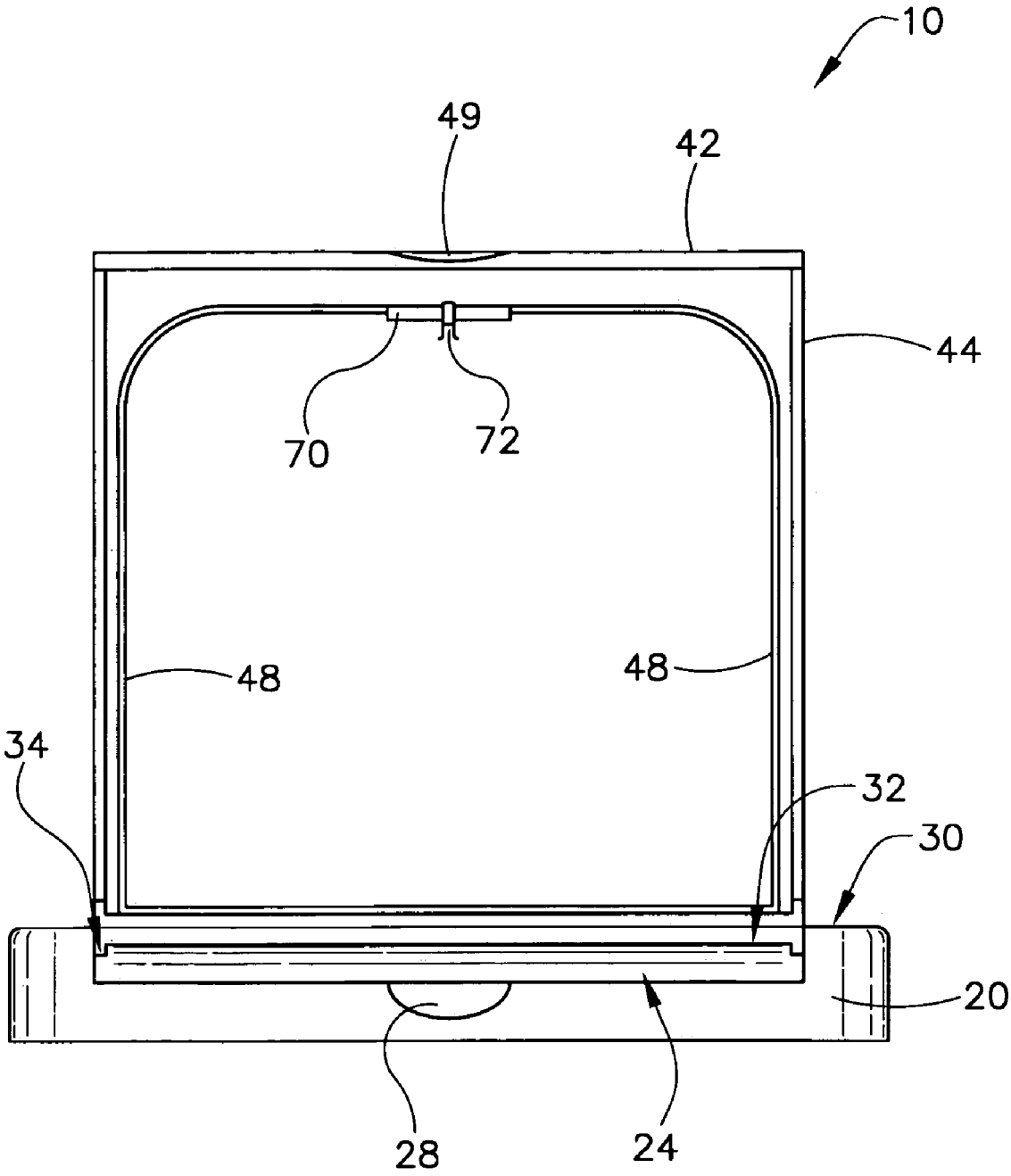
FIG. 4C is a side elevational view of a rectangular closure for a container according to yet another preferred embodiment illustrating the flap in an open position.
Figure 4D:
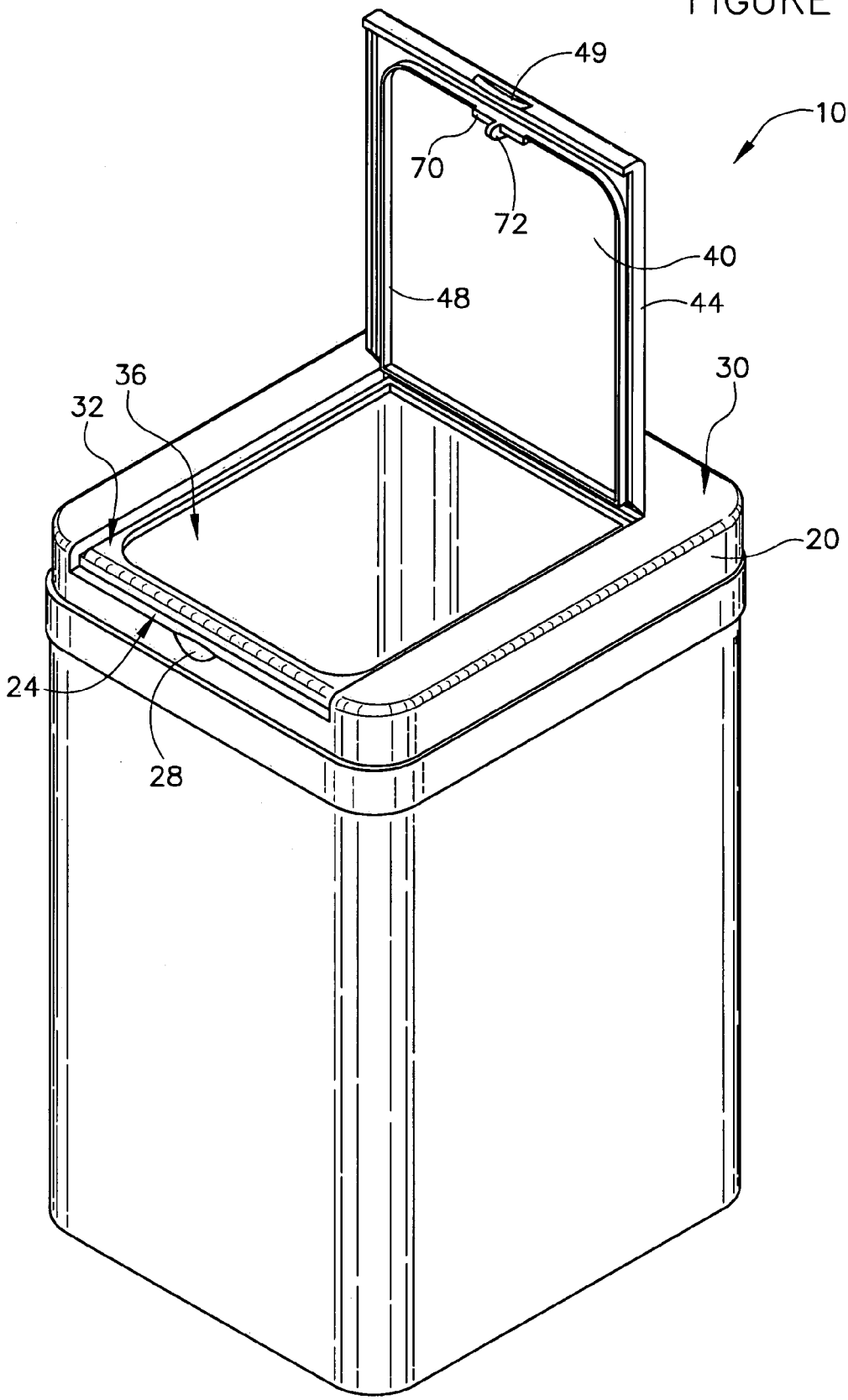
FIG. 4D is a perspective view of a rectangular closure for a container according to yet another preferred embodiment showing the closure coupled to a container and illustrating the flap in an open position.
Figure 5A:
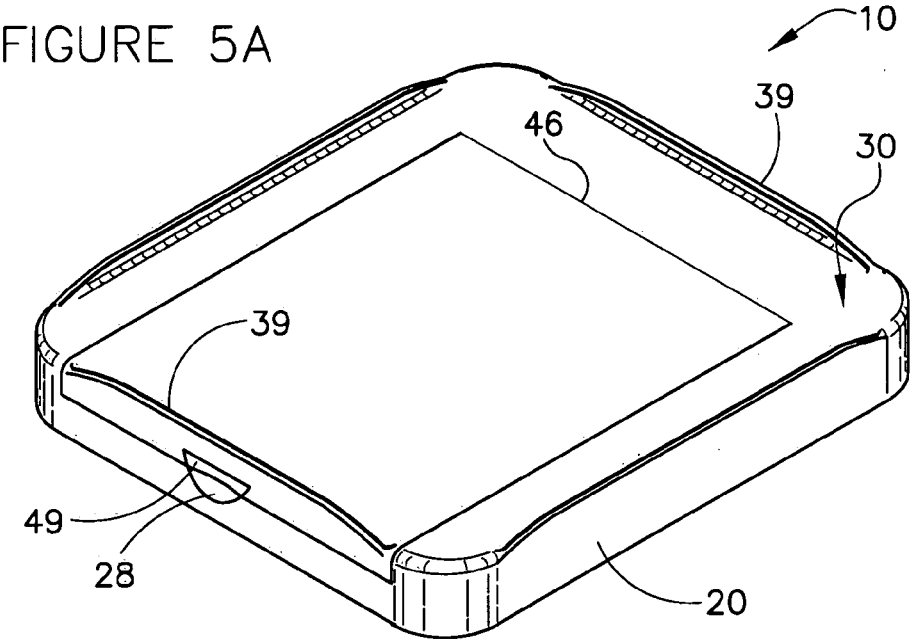
FIG. 5A is a perspective view of a rectangular closure for a container according to still another preferred embodiment illustrating the flap in a closed position.
Figure 5B:
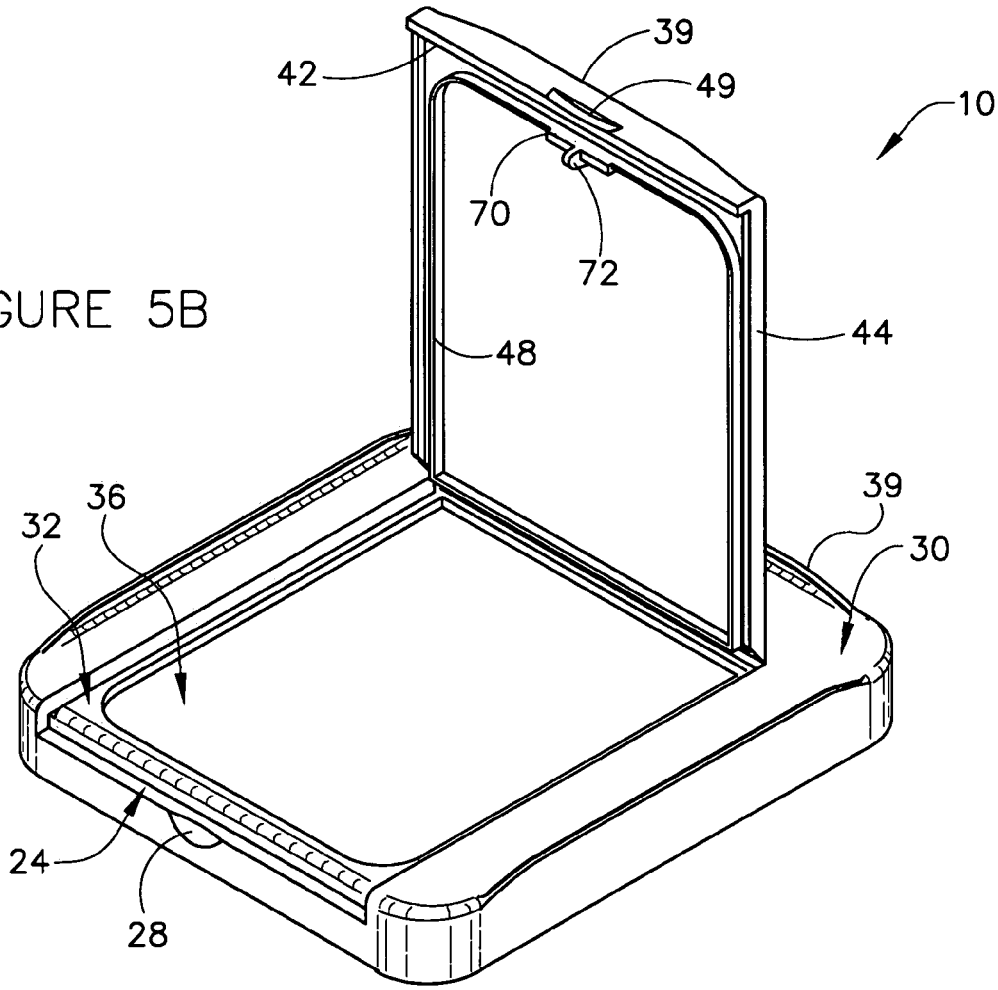
FIG. 5B is a perspective view of a rectangular closure for a container according to still another preferred embodiment illustrating the flap in an open position.
Figure 5C:
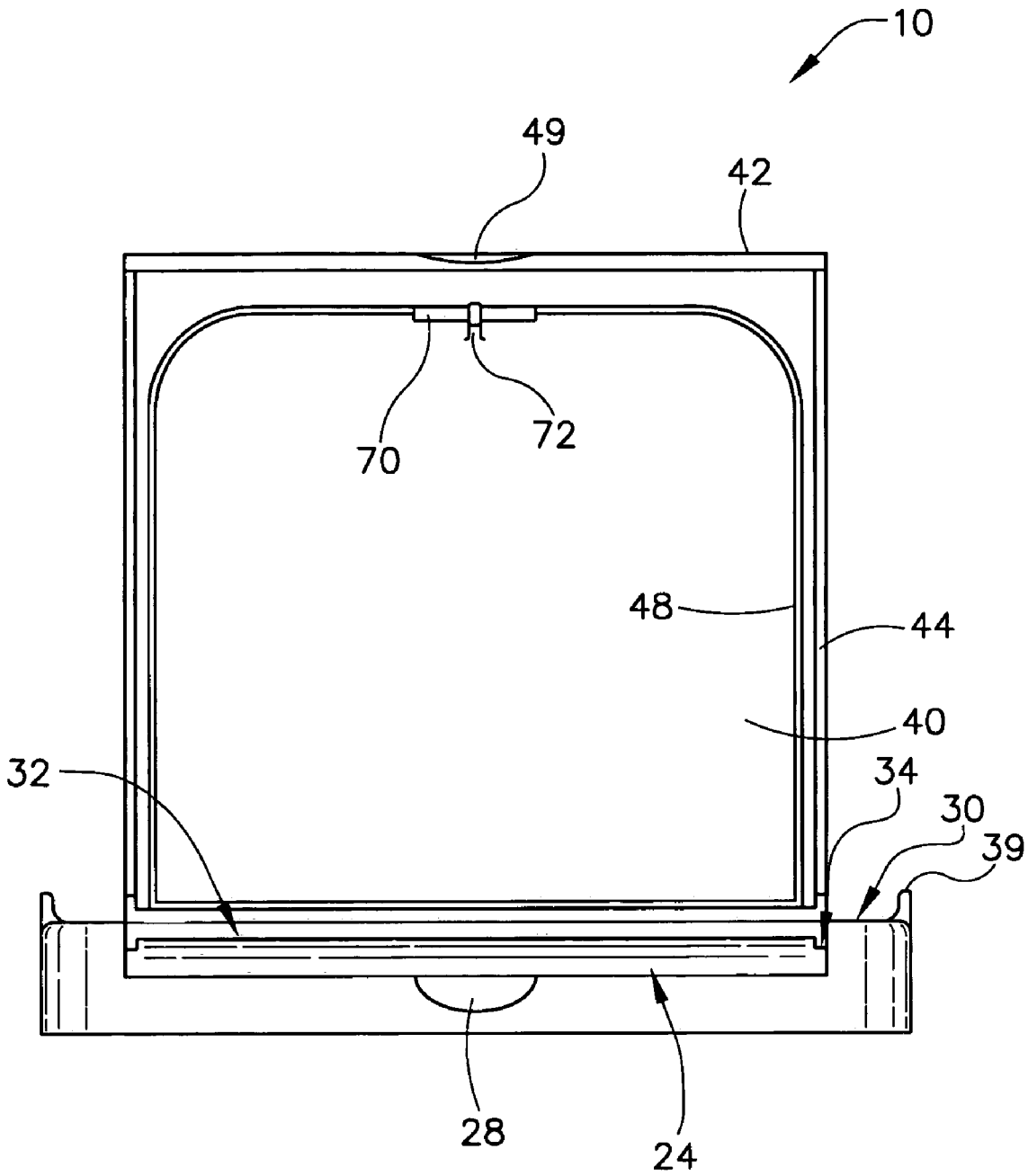
FIG. 5C is a side elevational view of a rectangular closure for a container according to still another preferred embodiment illustrating the flap in an open position.
Figure 5D:
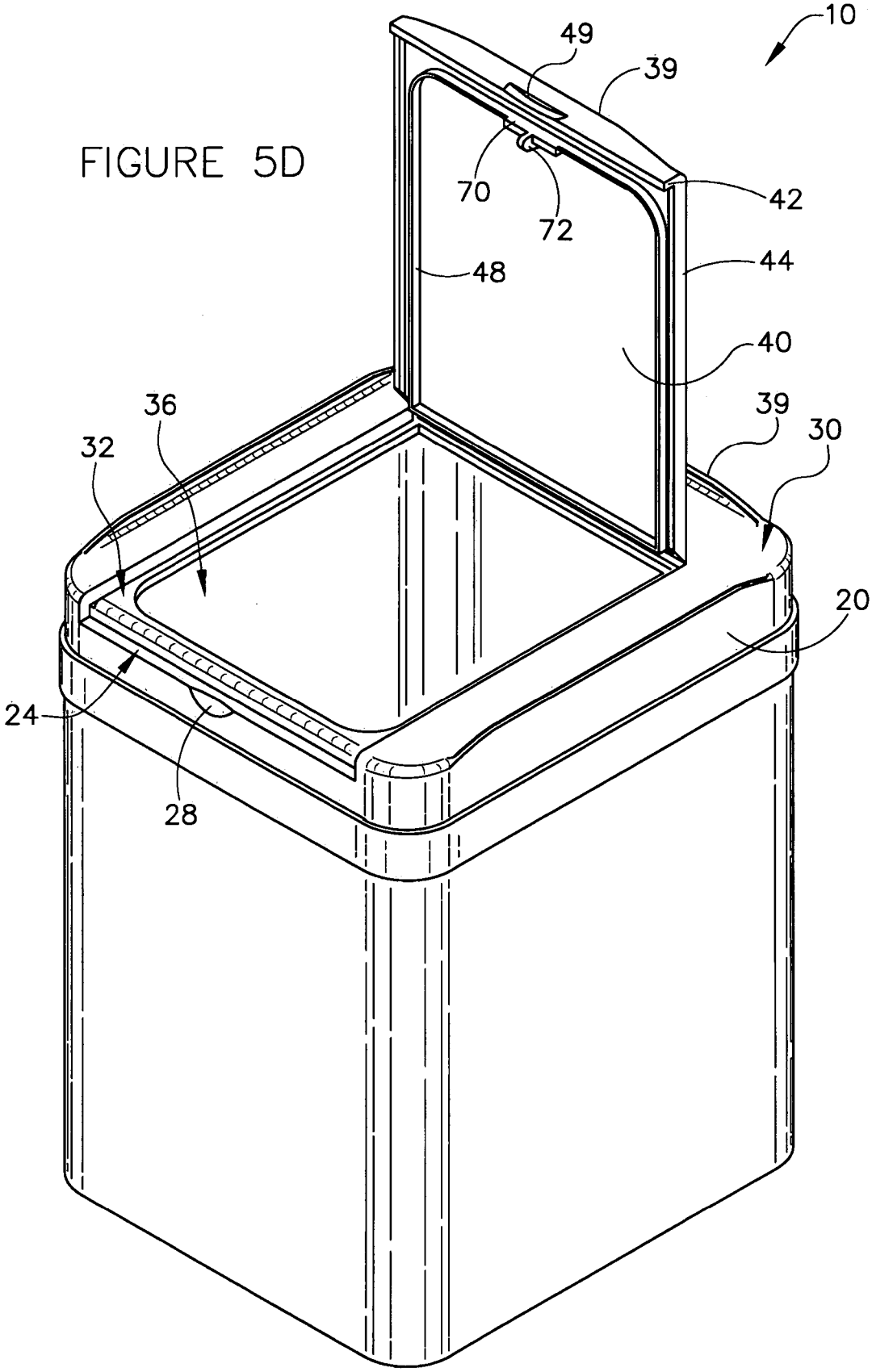
FIG. 5D is a perspective view of a rectangular closure for a container according to still another preferred embodiment showing the closure coupled to a container and illustrating the flap in an open position.

In a preferred embodiment, shown by way of example in FIG. 2F, a closure formed from two separate pieces is similar to an integrally formed closure. However, the closure formed from two separate pieces may additionally include suitable structure (e.g. coupling elements) to permit the pieces to be readily connected for use as a closure. Such coupling elements may include fingers 80 (e.g. projections, protrusions, barbs, etc.) that extend into apertures 82 (e.g. holes, openings, passages, etc.) configured to receive the fingers. The fingers and apertures may be configured such that the fingers frictionally engage with, or snap into, the apertures. According to one embodiment, the fingers may include barbs 84 (e.g. enlarged rings around the outside of the fingers, etc.) that are configured to provide for easy coupling (e.g. snapping, etc.) of the fingers to the apertures, but difficult uncoupling (e.g. unsnapping, etc.). Furthermore, the elements that are provided on each piece of a two-piece (or three-piece, etc.) closure may vary. In a preferred embodiment, one piece of the closure may include the spooning flap, the shaker flap, and a web positioned between the two flaps. The web may include either the fingers or the apertures and may serve a function similar to that of the non-recessed section of the top portion located between the flaps in an integrally formed closure. The second piece of the closure may include the bottom portion and the top portion, with the top portion including the other one of the fingers or the apertures. In alternative embodiments, different elements may be provided on the different pieces. For example, a base and top portion with dispensing openings may be integrally formed and one or two flaps may be formed separately for coupling (e.g. press-fit attachment, etc.) to the top portion.

According to any preferred embodiment, the closure for a container may be coupled to a container having an upper end that corresponds to the shape of the bottom portion of the closure. To couple the closure to the container, the closure is placed over the container and the bottom portion of the closure is pushed onto the container. As the closure is pushed onto the container, the snap ridge comes into contact with the mating ridge member on the container, slides away from the mating ridge member, and then when the closure is pushed far enough onto the container, the snap ridge moves past the mating ridge member and moves back toward the container. Once the snap ridge moves back toward the container (and is below the mating ridge member) the snap ridge engages the mating ridge member and "locks" the closure onto the container.

To dispense the contents of the container, the user places a finger in the indentation provided on the side of the closure under the desired flap. To open the flap, the user applies an upward force sufficient to overcome the frictional contact of the tab with the inner edge of the spooning opening (if the user is opening the spooning flap) or a shaker opening(s) (if the user is opening the shaker flap). Once the flap is open, the user may dispense the contents of the container as desired through the opening (e.g. spooning opening or shaker opening(s)) provided in the top portion. To close the flap, the user simply pivots the flap around its hinge toward the opening and then, as the tab of the flap begins to engage the inner edge of the opening, applies enough downward force to overcome the frictional contact of the tab with the inner edge of the opening. Once the flap is completely closed, the flap will be held in the closed position by the tab.

It is important to note that the closure for a container may be provided with one or two flaps that may be separable or integrally formed with the base or top portion, and that the opening(s) covered by the flap(s) may be any one or more of the variety of openings described above in relation the spooning opening and the shaker opening(s). For example, a rectangular closure having only one flap (as shown in FIGS. 4A through 5D) may include an opening(s) that resembles those described with respect to the spooning opening and/or those described with respect to the shaker opening(s). Thus, a rectangular closure may include a single spooning flap or a single shaker flap. Moreover, each of the features above may be combined with different combinations of other described features to create closures having different characteristics.

It is also important to note that the construction and arrangement of the elements of the rectangular closure as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces (e.g. tabs, fingers, apertures, etc.) may be reversed or otherwise varied, or the length or width of the structures and/or members or connectors or other elements of the system may be varied. It should be noted that the elements and/or assemblies of the system may be constructed from any of a wide variety of materials that provide sufficient strength or durability, in any of a wide variety of colors, textures and combinations. It should also be noted that the closure may be configured in a suitable shape (e.g. rectangular, triangular, oval, etc.) and used in association with a wide variety of other containers and in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. In a closure for a container having a first projection extending from an outside wall of the container, the closure comprising a base having a first end configured for mounting on a container and a second end enclosed by a top portion, the top portion comprising a platform having at least one opening for dispensing material from the container, at least one flap coupled to the top portion and movable between an open position for dispensing the material and a closed position for covering the opening, the improvement comprising:

a second projection extending from an inside wall of the base toward the top portion and configured to coact with the first projection on the container, so that the closure is configured to resist separation from the container once the closure has been attached to the container, wherein the first projection includes a first barb and the second projection includes a second barb, the first barb and the second barb configured to coact to resist separation of the closure from the container.

2. The closure of claim 1 wherein the base has a rectangular shape.

3. The closure of claim 1 wherein the base and the top portion are integrally formed as a single piece.

4. The closure of claim 1 wherein the first projection extends substantially around the outside wall of the container and the second projection extends substantially around the inside wall of the closure.

5. The closure of claim 1 wherein the at least one flap is integrally formed with the top portion.

6. In a closure for a container having a first projection extending from an outside wall of the container, the closure comprising a base having a first end configured for mounting on a container and a second end enclosed by a top portion, the top portion comprising a platform having at least one opening for dispensing material from the container, at least one flap coupled to the top portion and movable between an open position for dispensing the material and a closed position for covering the opening, the improvement comprising:

a second projection extending from an inside wall of the base toward the top portion and configured to coact with the first projection on the container, so that the closure is configured to resist separation from the container once the closure has been attached to the container; and at least one channel formed in the top portion and configured to drain moisture away from the opening.

7. In a closure for a container comprising a base having a first end configured for attachment to the container and a second end at least partially covered by a top portion, the top portion comprising at least one opening for dispensing a material from the container and at least one flap pivotally coupled to the top portion for movement between an open position for dispensing material and a closed position to cover the opening, the improvement comprising:

a tab extending from an underside of the flap;

a guide formed with the tab and having a guide surface configured to engage an edge of the opening in a wedging interaction;

so that the flap is retained in the closed position by engagement between the tab and the edge of the opening.

8. The closure of claim 7 wherein the flap is retained in the closed position by frictional engagement between the tab and the edge of the opening.

9. The closure of claim 7 wherein the first end of the base is configured for attachment to a rectangular opening on the container.

10. The closure of claim 7 further comprising a lip extending upwardly from at least one of the top portion and the flap, so that the closure is configured to receive a bottom of a container stacked atop the closure.

11. The closure of claim 7 wherein the flaps are separable from the top portion.

12. The closure of claim 7 further comprising a snap ridge projecting from an inside wall of the base and configured to engage a corresponding projection extending from the container.

13. The closure of claim 7 wherein the top portion and the base are integrally formed.

14. The closure of claim 7 further comprising at least one finger configured to coact with at least one aperture for coupling the flap to the top portion.

15. The closure of claim 14 further comprising a first projection extending upwardly from an inside surface of the wall and configured to engage a corresponding second projection on an outside surface of the container so that the projections are configured to coact and resist removal of the closure once the closure is attached to the container.

16. In a closure for a container comprising a base having a first end configured for attachment to the container and a second end coupled to a top portion, the top portion comprising at least one opening for dispensing a material from the container and at least one flap pivotally coupled to the top portion by a hinge for movement between an open position for dispensing material and a closed position to cover the opening, the improvement comprising:

a first channel and a second channel formed in the top portion;

a first projection extending from a first side of the flap and configured to fit at least partially within the first channel when the flap is in the closed position;

a second projection extending from a second side of the flap opposite the first side of the flap and configured to fit at least partially within the second channel when the flap is in the closed position;

so that the channels and the projections form a structure resistant to intrusion of external materials when the flap is in the closed position.

17. The closure of claim 16 wherein the base comprises a rectangular wall.

18. The closure of claim 16 wherein the base, the top portion and the flaps are integrally formed in a single operation.

19. The closure of claim 16 further comprising a projection extending from an underside of the flap and configured to engage an edge of the opening in a wedging interaction to create a frictional fit configured to retain the flap in the closed position.

20. The closure of claim 16 wherein flap further comprises a skirt projecting downwardly from a front of the flap and the base farther comprises a recess configured to receive the skiff when the flap is in the closed position.

21. The closure of claim 16 wherein the first channel and the first projection are substantially straight and the second channel and the second projection are substantially straight and parallel to the first channel and the first projection.

* * * * *

UNITED STATES PATENT AND TRADEMARK OFFICE

CERTIFICATE OF CORRECTION

PATENT NO. : 7,258,255 B2
APPLICATION NO. : 10/764819
DATED : August 21, 2007
INVENTOR(S) : William C. Vogel and Terrence M. Parve It is certified that error appears in the above-identified patent and that said Letters Patent is hereby corrected as shown below:

Column 16:

Line 22; replace “farther” with --further--

Column 16:

Line 23; replace “skiff” with --skirt--

Signed and Sealed this

Twenty-fifth Day of December, 2007

JON W. DUDAS
*Director of the United States Patent and Trademark Office*